US007432309B2

(12) United States Patent
Vinson

(10) Patent No.: US 7,432,309 B2
(45) Date of Patent: Oct. 7, 2008

(54) PAPER SOFTENING COMPOSITIONS CONTAINING LOW LEVELS OF HIGH MOLECULAR WEIGHT POLYMERS AND SOFT TISSUE PAPER PRODUCTS COMPRISING SAID COMPOSITIONS

(75) Inventor: Kenneth Douglas Vinson, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 128 days.

(21) Appl. No.: 10/688,118

(22) Filed: Oct. 17, 2003

(65) Prior Publication Data

US 2004/0082668 A1 Apr. 29, 2004

Related U.S. Application Data

(60) Provisional application No. 60/419,255, filed on Oct. 17, 2002.

(51) Int. Cl.
*D21H 21/14* (2006.01)
*B01F 3/08* (2006.01)

(52) U.S. Cl. ..... 516/53; 516/54; 252/8.63; 162/168.2; 162/179

(58) Field of Classification Search ..... 516/53, 516/54; 252/8.63
See application file for complete search history.

(56) References Cited

U.S. PATENT DOCUMENTS

| | | | | |
|---|---|---|---|---|
| 3,301,746 | A | 1/1967 | Sanford et al. | |
| 3,473,576 | A | 10/1969 | Amneus | |
| 3,573,164 | A | 3/1971 | Friedberg et al. | |
| 3,624,019 | A * | 11/1971 | Anderson et al. | 523/336 |
| 3,700,623 | A | 10/1972 | Kleim | |
| 3,772,076 | A | 11/1973 | Kleim | |
| 3,812,000 | A | 5/1974 | Salvucci, Jr. et al. | |
| 3,821,068 | A | 6/1974 | Shaw | |
| 3,934,005 | A | 1/1976 | Albert | |
| 3,974,025 | A | 8/1976 | Ayers | |
| 4,011,389 | A | 3/1977 | Langdon et al. | |
| 4,191,609 | A | 3/1980 | Trokhan | |
| 4,208,459 | A | 6/1980 | Becker et al. | |
| 4,239,065 | A | 12/1980 | Trokhan | |
| 4,266,962 | A | 5/1981 | Kersting et al. | |
| 4,300,981 | A | 11/1981 | Carstens | |
| 4,413,087 | A | 11/1983 | Bernot | |
| 4,447,413 | A | 5/1984 | Rippstein, Jr. | |
| 4,510,081 | A | 4/1985 | Bronner et al. | |
| 4,528,239 | A | 7/1985 | Trokhan | |
| 4,637,859 | A | 1/1987 | Trokhan | |
| 4,745,154 | A * | 5/1988 | Ruffner | 524/801 |
| 4,874,465 | A | 10/1989 | Cochrane et al. | |
| 4,971,714 | A | 11/1990 | Lokkesmoe et al. | |
| 4,981,557 | A | 1/1991 | Bjorkquist | |
| 5,059,282 | A | 10/1991 | Ampulski et al. | |
| 5,215,626 | A | 6/1993 | Ampulski et al. | |
| 5,221,435 | A | 6/1993 | Smith | |
| 5,228,954 | A | 7/1993 | Vinson et al. | |
| 5,246,545 | A | 9/1993 | Ampulski et al. | |
| 5,264,082 | A | 11/1993 | Phan et al. | |
| 5,358,988 | A * | 10/1994 | Schieferstein et al. | 524/280 |
| 5,405,499 | A | 4/1995 | Vinson | |
| 5,415,737 | A | 5/1995 | Phan et al. | |
| 5,487,813 | A | 1/1996 | Vinson et al. | |
| 5,499,198 | A | 3/1996 | Gaidos et al. | |
| 5,510,000 | A | 4/1996 | Phan et al. | |
| 5,525,345 | A | 6/1996 | Warner et al. | |
| 5,525,575 | A | 6/1996 | Chamberlain | |

(Continued)

FOREIGN PATENT DOCUMENTS

EP 0617164 A1 9/1994

(Continued)

OTHER PUBLICATIONS

Miller, D. J.; Henning, T.; Grunbein, W; "Phase inversion of W/O emulsions by adding hvdrophilic surfactant—a technique for making products", Colloids and Surfaces A: Physicochemtcal and Engineering Aspects, vols. 183-185, Jul. 15, 2001, pp. 681-685 and 687-688.*

(Continued)

*Primary Examiner*—Eric Hug
*Assistant Examiner*—Dennis Cordray
(74) *Attorney, Agent, or Firm*—Peter T. Nguyen; Betty J. Zea; Stephen T. Murphy

(57) ABSTRACT

Disclosed is a composition suitable for atomizing without excessive aerosolization in the form of an oil-in-water emulsion comprising: a) a continuous aqueous phase, and b) a discontinuous oil phase wherein the rheology of the aqueous phase is modified by the addition of a water-in-oil emulsion comprising: i) a high molecular weight polymer in a discontinuous aqueous phase, and ii) a continuous organic solvent phase. Preferred embodiments of the present invention relate to compositions for softening an absorbent paper tissue comprising a) a quaternary ammonium softening active ingredient; b) an electrolyte; c) a high molecular weight polymer emulsion comprising: i) from about 20% to about 40% by weight of the premix of a high molecular weight polymer; ii) from about 40% to about 60% of water; and iii) from about 20% to about 40% of an organic solvent; and d) a vehicle in which said softening active ingredient is dispersed.

9 Claims, 1 Drawing Sheet

U.S. PATENT DOCUMENTS

| | | | | |
|---|---|---|---|---|
| 5,529,975 | A * | 6/1996 | Chamberlain | 504/361 |
| 5,538,595 | A | 7/1996 | Trokhan et al. | |
| 5,543,067 | A | 8/1996 | Phan et al. | |
| 5,573,637 | A | 11/1996 | Ampulski et al. | |
| 5,611,890 | A | 3/1997 | Vinson et al. | |
| 5,637,743 | A | 6/1997 | Contet et al. | |
| 5,656,132 | A | 8/1997 | Farrington et al. | |
| 5,750,492 | A | 5/1998 | Contet et al. | |
| 5,753,079 | A | 5/1998 | Jenny et al. | |
| 5,800,675 | A | 9/1998 | Kinsley | |
| 5,814,188 | A | 9/1998 | Vinson et al. | |
| 6,040,071 | A | 3/2000 | Broaze et al. | |
| 6,103,793 | A | 8/2000 | Osmond | |
| 6,146,648 | A | 11/2000 | Leboeuf et al. | |
| 6,162,329 | A | 12/2000 | Vinson et al. | |
| 6,214,331 | B1 * | 4/2001 | Vanderhoff et al. | 424/78.17 |
| 6,214,771 | B1 | 4/2001 | Dexter | |
| 6,228,223 | B1 | 5/2001 | Thebrin et al. | |
| 6,420,013 | B1 | 7/2002 | Vinson et al. | |
| 6,485,651 | B1 * | 11/2002 | Branning | 210/702 |
| 6,547,928 | B2 | 4/2003 | Barnholtz et al. | |
| 2001/0006676 | A1 | 7/2001 | Leboeuf et al. | |

FOREIGN PATENT DOCUMENTS

| | | | |
|---|---|---|---|
| EP | 0677612 | A2 | 10/1995 |
| EP | 0688901 | A2 | 12/1995 |
| GB | 2 107 986 | A | 5/1983 |
| WO | WO 97/17938 | A | 5/1997 |
| WO | WO 00/22231 | | 4/2000 |
| WO | WO 00/22233 | | 4/2000 |
| WO | WO 02/48458 | A | 6/2002 |

OTHER PUBLICATIONS

Mini-Encyclopedia of Papermaking Wet Chemistry (topic: polyethylene imine (PEI) [online], [retreived May 31, 2007]. Retrieved from the Internet<URL:http://www.4.ncsu.edu/~hubbe/PEI.htm>.*

Pelletier et al "Effect of Retention/Drainage Aids on Formation", BASF Corporation, p. 2, Fig. 5 [online], [retreived on May 31, 2007]. Retreived from the Internet <URL: http://www.basf.com/businesses/consumer/dispersions/usa/paper/articles/form.pdf>.*

International Search Report—PCT/US 03/32861—Oct. 17, 2003.

Taranaki Nuchem Limited, Lo-Drift*, Spray Drift Reducer, Feb. 19, 2003, Tapuae Partnership, New Plymouth, New Zealand.

CIBA Specialty Chemicals, Inc., Ciba® Percol® E20, Sep. 2002, Ciba Specialty Chemicals Corporation, Suffolk, Virginia.

Heping O. Zhu, Robin W. Dexter, Robert D. Fox, Donald L. Reichard, Ross D. Brazee, H. E. Ozkan, Droplet Size And Viscosity Effects In Recirculated Polymer Spray Solutions, Jul. 25, 2003, Tektran Agricultural Research Service, Wooster, Ohio, www.nal.usda.gov/ttic/tektran/data/000007/05/0000070555.html.

Terra International, Inc., Subcide™, Nonionic Polymer Carrier & Drift Retardant, Riverside® Serves Agriculture, Sioux City, Iowa, no date.

Helena Chemical Company, Adjuvants, Jul. 25, 2003, Helena Chemical Company Western Business Unit, www.helenachemical-west.com/products/adj products.htm.

Erdal Ozkan, Drift Can and Should Be Reduced to a Minimum, Do "Drift Retardant" Chemical Work?, Ag News, Vol. 4-No. 3 Jun.-Jul. 2002, The Ohio State University, The United States Department of Agriculture, Van Wert County, Ohio, www.kleinschmidt.5@osu.edu.

School of Agronomy and Horticulture, The Centre for Pesticide Application and Safety, The Use of Adjuvants For Reducing Spray Drift, Aug. 14, 2002, The University of Queensland Gatton, Gatton, Queensland 4343 Australia, www.aghort.uq.edu.au-cpas/info-adjuvant-reducingdrift.html.

Hermans, et al. in U.S. Statutory Invention Registration H1672 published Aug. 5, 1997.

* cited by examiner

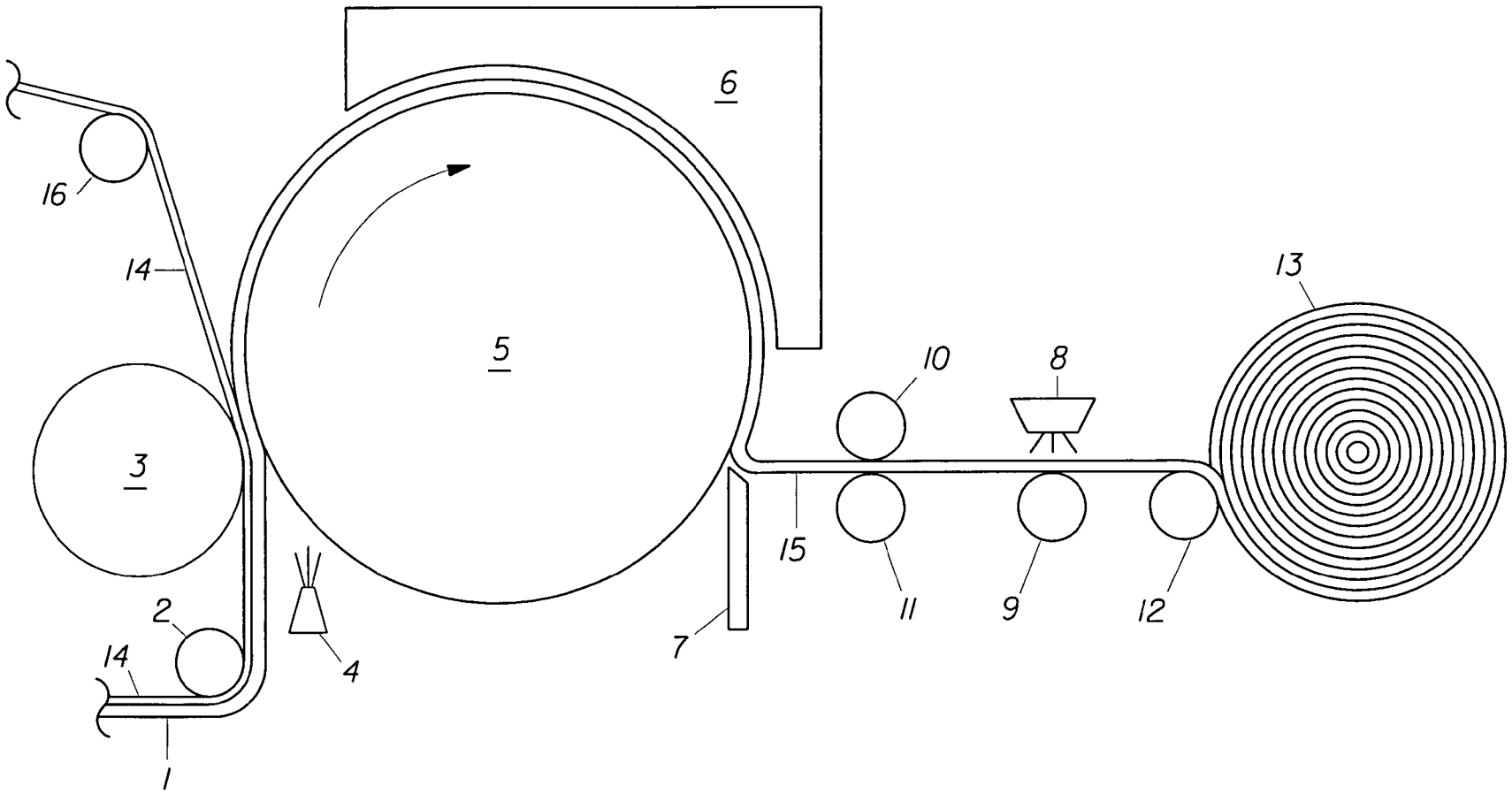
13
12
8
9
10
11
15
6
7
5
4
2
1
14
3
14
16

PAPER SOFTENING COMPOSITIONS CONTAINING LOW LEVELS OF HIGH MOLECULAR WEIGHT POLYMERS AND SOFT TISSUE PAPER PRODUCTS COMPRISING SAID COMPOSITIONS

CROSS REFERENCE TO RELATED APPLICATIONS

This application claims the benefit of U.S. Provisional Application No. 60/419,255, filed Oct. 17, 2002.

TECHNICAL FIELD

This invention relates, in general, to the modification of the rheology properties of oil-in-water emulsions with high molecular weight polymers delivered from a water-in-oil emulsion. These modifications of the rheological properties improve the ability to spray the oil-in-water emulsion. Specifically, the paper softening compositions of the present invention more effectively reduce the spray fracture of the composition when passed through a spray apparatus for application onto the paper. Specifically, this invention relates to paper softening compositions that may be applied to-tissue paper for enhancing the softness thereof. The invention also relates to soft, tissue paper products containing these compositions.

BACKGROUND OF THE INVENTION

Making soft tissue and toweling products which promote comfortable cleaning without performance impairing sacrifices has long been the goal of the engineers and scientists who are devoted to research into improving tissue paper. There have been numerous attempts to reduce the abrasive effect, i.e., improve the softness of tissue products. One area which has received a considerable amount of attention is the addition of chemical softening agents (also referred to herein as "chemical softeners") to tissue and toweling products.

The field of work in the prior art pertaining to chemical softeners has taken two paths. The first path is characterized by the addition of softeners to the tissue paper web during its formation, either by adding a softening ingredient to the vats of pulp which will ultimately be formed into a tissue paper web, to the pulp slurry as it approaches a paper making machine, or to the wet web as it resides on a Fourdrinier cloth or dryer cloth on a paper making machine. See U.S. Pat. No. 5,264,082, issued to Phan and Trokhan on Nov. 23, 1993, and U.S. Pat. No. 5,059,282, issued to Ampulski, et. al. on Oct. 22, 1991.

The second path is categorized by the addition of chemical softeners to tissue paper web after the web is dried or over-dried. Applicable processes can be incorporated into the paper making operation as, for example, by spraying onto the dry web before it is wound into a roll of paper. Exemplary art from this field includes U.S. Pat. No. 5,215,626, issued to Ampulski, et. al. on Jun. 1, 1993; U.S. Pat. No. 5,246,545, issued to Ampulski, et. al. on Sep. 21, 1993; U.S. Pat. No. 5,525,345, issued to Warner, et. al. on Jun. 11, 1996, U.S. Pat. No. 6,162,329, issued to Vinson on Dec. 19, 2000, U.S. Pat. No. 6,179,691, issued to Ficke et al. on Jan. 30, 2001; U.S. Pat. No. 6,261,580, issued to Trokhan et al. on Jul. 17, 2001; U.S. Pat. No. 6,420,013, issued to Vinson et al. on Jul. 16, 2002, PCT Applications WO 00/22231 and 00/22233, filed in the name of Vinson et al., published on Apr. 20, 2000; and PCT Application WO 02/48458, filed in the name of Vinson et al., published on Jun. 20, 2002.

Those skilled in the art will recognize that both technology paths, more particularly the second path, are advanced by inventions of chemical softening mixtures having liposomal microstructures present at high concentrations in a vehicle. The most recent of the development work in this area has focused on the improvement of the rheological properties of the chemical softening compositions. U.S. Pat. No. 6,162,329 teaches the use of high concentration compositions of softening agents that maintain a viscosity at a level where they can be easily applied to the web. Specifically, U.S. Pat. No. 6,162,329 teaches the addition of electrolytes to the composition. PCT Applications WO 00/22231 and WO 00/22233 further improve the rheology properties of the high concentration compositions by utilizing a bilayer disrupter to create a micellular structure which allows for more efficient application of the chemical softener to the paper web.

PCT Application WO 02/48458 discloses the use of a preferred combination of a quaternary ammonium softening active ingredient, an electrolyte, a bilayer disrupter and a high molecular weight polymer as a softening composition that reduces spray fracture upon spraying. Example 1 of WO 02/48458 depicts a chemical softening composition containing polyacrylamide, where the polyacrylamide is added directly to the water. The compositions therein may comprise from about 0.01 to about 5% by weight.

Unfortunately, these compositions, when they are sprayed onto the paper product, experience inconsistent spray performance where the level of spray fracture reduction is, at times, insufficient to continuously spray effectively. Without being limited by theory, it is believed that the addition of high molecular weight polymers in their natural form, generally a powder, results in a very slow hydration of the polymer from its coiled solid state to a fully expanded, hydrated state. As a result, depending on how long after mixing and the storage conditions of the mixture, the polymer will have different states when used in the production operation, yielding inconsistent performance characteristics.

Further, in many cases it is impossible to pre-disperse the high molecular weight polymer in the vehicle in an attempt to achieve the fully expanded conformation. Often, the dilution levels required to obtain a dispersion of expanded conformation polymer are so low that when even a small amount of high molecular weight polymer is needed to adjust the rheology of the oil-in-water emulsion to improve sprayability, too much vehicle is delivered to the emulsion thereby undesirably changing the characteristics of the final oil-in-water emulsion. If in response to this, it is attempted to pre-disperse the polymer in a higher concentration dilution, the polymer does not achieve the fully expanded or relaxed conformation needed for optimal rheology control.

Accordingly, it is desirable to find a way to further improve the rheology control of oil-in-water emulsions, to be able to provide a more stable composition which consistently results in reduced spray fracture. Such improved products, compositions, and processes are provided by the present invention as is shown in the following disclosure.

SUMMARY OF THE INVENTION

The present invention relates to a composition suitable for atomizing without excessive aerosolization in the form of an oil-in-water emulsion comprising: a) a continuous aqueous phase, and b) a discontinuous oil phase wherein the rheology of the aqueous phase is modified by the addition of a water-in-oil emulsion comprising: i) a high molecular weight polymer in a discontinuous aqueous phase, and ii) a continuous organic solvent phase.

Preferred embodiments of the present invention relate to compositions for softening an absorbent paper tissue comprising a) a quaternary ammonium softening active ingredient; b) an electrolyte; c) a high molecular weight polymer emulsion comprising: i) from about 20% to about 40% by weight of the premix of a high molecular weight polymer; ii) from about 40% to about 60% of water; and iii) from about 20% to about 40% of an organic solvent; and d) a vehicle in which said softening active ingredient is dispersed.

BRIEF DESCRIPTION OF THE FIGURE

While the specification concludes with claims particularly pointing out and distinctly claiming the present invention, it is believed that the present invention will be better understood from the following description in conjunction with the appended example and with the following drawing, in which like reference numbers identify identical elements and wherein:

The FIGURE is a schematic representation illustrating a preferred embodiment of the process of the present invention of adding a softening composition compounds to a tissue web.

The present invention is described in more detail below.

DETAILED DESCRIPTION OF THE INVENTION

Briefly, the present invention provides a composition which may be applied to a tissue web, most preferably applied to the surface of a dry tissue web, an overdried tissue web, or to a semi-dry tissue web. The resulting tissue paper has enhanced tactilely perceivable softness.

The term "emulsion" as used herein refers to a heterogeneous mixture of generally insoluble liquids comprising an aqueous phase and an organic or oil phase. Either the aqueous phase or the the organic, oil phase may additionally comprise other compatible materials dissolved, suspended or dispersed within the respective phase. The term "oil-in-water emulsion" refers to an emulsion in which the oil phase is discontinuous and exists as discrete spheres or particles of the oil or organic material suspended in a continuous body of the aqueous phase. The term "water-in-oil emulsion" refers to an emulsion in which the aqueous phase is the discontinuous phase and the oil phase is the continuous phase.

The term rheology as used herein means the flow characteristics of a liquid, emulsion or dispersion as measured by standard properties including but not limited to viscosity, extensional viscosity, and elasticity. In general, the rheology of an emulsion or dispersion is determined by the rheological properties of the continuous phase.

The term "vehicle" as used herein means a fluid that completely dissolves a chemical papermaking additive, or a fluid that is used to emulsify a chemical papermaking additive, or a fluid that is used to suspend a chemical papermaking additive. The vehicle may also serve as a carrier that contains a chemical additive or aids in the delivery of a chemical papermaking additive. All references are meant to be interchangeable and not limiting. The dispersion is the fluid containing the chemical papermaking additive. The term "dispersion" as used herein includes true solutions, suspensions, and emulsions. For purposes for this invention, all terms are interchangeable and not limiting. If the vehicle is water or an aqueous solution, then, preferably, the hot web is dried to a moisture level below its equilibrium moisture content (at standard conditions) before being contacted with the composition. However, this process is also applicable to tissue paper at or near its equilibrium moisture content as well.

As used herein, the term "hot tissue web" refers to a tissue web which is at an elevated temperature relative to room temperature. Preferably the elevated temperature of the web is at least about 43° C., and more preferably at least about 65° C.

The term "dry tissue web" as used herein includes both webs which are dried to a moisture content less than the equilibrium moisture content thereof (overdried-see below) and webs which are at a moisture content in equilibrium with atmospheric moisture. A semi-dry tissue paper web includes a tissue web with a moisture content exceeding its equilibrium moisture content. Most preferably the composition herein is applied to a dry tissue paper web.

The moisture content of a tissue web is related to the temperature of the web and the relative humidity of the environment in which the web is placed. As used herein, the term "overdried tissue web" refers to a tissue web that is dried to a moisture content less than its equilibrium moisture content at standard test conditions of 23° C. and 50% relative humidity. The equilibrium moisture content of a tissue web placed in standard testing conditions of 23° C. and 50% relative humidity is approximately 7%. A tissue web of the present invention can be overdried by raising it to an elevated temperature through use of drying means known to the art such as a Yankee dryer or through air drying. Preferably, an overdried tissue web will have a moisture content of less than 7%, more preferably from about 0 to about 6%, and most preferably, a moisture content of from about 0 to about 3%, by weight.

Paper exposed to the normal environment typically has an equilibrium moisture content in the range of 5 to 8%. When paper is dried and creped the moisture content in the sheet is generally less than 3%. After manufacturing, the paper absorbs water from the atmosphere. In the preferred process of the present invention, advantage is taken of the low moisture content in the paper as it leaves the doctor blade as it is removed from the Yankee dryer (or the low moisture content of similar webs as such webs are removed from alternate drying means if the process does not involve a Yankee dryer).

The term "atomize" or "atomization" as used herein refers to droplets or the formation of droplets that are sufficiently small to be a discrete spray but are large enough that the direction and velocity of the droplets are generally unchanged so the droplets are delivered to the target surface.

The term "aerosol", "aerosolized", or "aerosolization" as used herein refers to droplets or the formation of droplets that are sufficiently small that direction and velocity of movement of the droplets may be changed such that the droplets are not delivered to the target surface of the spray.

The term "spray fracture" as used herein is intended to mean separation of the flow of a composition within a spray apparatus into individual droplets having a size that is sufficiently small that they become aerosolized. It is believed that the incorporation of the high molecular weight polymers increase the extensibility of the softening composition resulting in a more uniform distribution of spray droplets having a size large enough that substantially all of the material is atomized and not aerosolized such that substantially all of the material deposits onto the web rather than being carried outside the vicinity of the web by air flows adjacent thereto. (i.e., the droplets are deposited rather than being aerosolized).

All documents cited are, in relevant part, incorporated herein by reference; the citation of any document is not to be construed as an admission that it is prior art with respect to the present invention.

All percentages, ratios and proportions herein are by weight, unless otherwise specified.

Oil-in-Water Emulsion

The present invention relates to a composition for atomizing without excessive aerosolization wherein the composition is in the form of an oil-in-water emulsion comprising a continuous aqueous phase and a discontinuous oil phase wherein the rheology of the aqueous phase is modified by the addition of a water-in-oil emulsion comprising a high molecular weight polymer in a discontinuous aqueous phase and a continuous oil or organic solvent phase.

Preferred embodiments of the oil-in-water emulsion of the present invention are paper softening compositions comprising softening active ingredients in the oil phase in an aqueous vehicle.

Softening Composition

It is known that very low levels of softener additives, e.g. cationic softeners, provide a significant tissue softening effect when applied to the surface of tissue webs in accordance with the present invention. Since the preferred softening compositions of the present invention have a high concentration of softening active when the softening composition is applied to the paper, a relatively low amount of the vehicle is applied to the web. Therefore, the composition can be applied to dry tissue webs without disrupting the dry fiber structure of the paper web and no further drying of the tissue web is required. Further, since the softening composition of the present invention contains a minimal level of non-functional ingredients, the composition has a minimal effect on the strength of a tissue web after it has been applied. In order to maintain this dry character on the sheet, only very low levels of additional vehicle may be added to the composition without impacting the quality of the product.

In general, the softening composition of the present invention comprises a softening active ingredient, an electrolyte, a vehicle and a very low level of high molecule weight polymer delivered to the composition in a water-in-oil emulsion. Without being limited by theory, it is believed that these low levels are successfully used because the high molecular weight polymer exists in the water-in-oil emulsion already in its relaxed conformation. Upon addition to the oil-in-water composition, it has been surprisingly been found that the polymer most efficiently fully disperses throughout the aqueous vehicle phase, thereby most directly modifying the rheology of the composition as desired. This results in a more efficient use of the polymer as well as a more consistent solution/dispersion.

When applied to tissue paper as described herein, such compositions are effective in softening the tissue paper. The following discusses each of the components of the softening composition of the present invention, the properties of the composition, methods of producing the composition, and methods of applying the composition.

Softening Active Ingredients

The preferred oil-in-water emulsions of the present invention, paper softening compositions, comprises softening active ingredients in the discontinuous oil phase. As used herein, the term "softening active ingredient" refers to any chemical ingredient which improves the tactile sensation perceived by the consumer who holds a particular paper product and rubs it across the skin. Although somewhat desirable for towel products, softness is a particularly important property for facial and toilet tissues. Such tactilely perceivable softness can be characterized by, but is not limited to, friction, flexibility, and smoothness, as well as subjective descriptors, such as a feeling like lubricious, velvet, silk or flannel. Suitable materials include those which impart a lubricious feel to tissue. This includes, for exemplary purposes only, basic waxes such as paraffin and beeswax and oils such as mineral oil and silicone oil as well as petrolatum and more complex lubricants and emollients such as quaternary ammonium compounds with long alkyl chains, functional silicones, fatty acids, fatty alcohols and fatty esters. Especially preferred softening actives are quaternary ammonium compounds; mono-, di-, or triester quaternary ammonium compounds; di-quaternary esterified ammonium compounds, or mixtures thereof.

Quaternary compounds have the formula:

$$(R_1)_{4-m}—N^+—[R_2]_m X^-$$

where m is 1 to 3; each $R_1$ is a $C_1$-$C_6$ alkyl group, hydroxyalkyl group, hydrocarbyl or substituted hydrocarbyl group, alkoxylated group, benzyl group, or mixtures thereof; each $R_2$ is a $C_{14}$-$C_{22}$ alkyl group, hydroxyalkyl group, hydrocarbyl or substituted hydrocarbyl group, alkoxylated group, benzyl group, or mixtures thereof; and $X^-$ is any softener-compatible anion suitable for use in the present invention. Preferably, each $R_1$ is methyl and $X^-$ is chloride or methyl sulfate. Preferably, each $R_2$ is $C_{16}$-$C_{18}$ alkyl or alkenyl, most preferably each $R_2$ is straight-chain $C_{18}$ alkyl or alkenyl. Optionally, the $R_2$ substituent can be derived from vegetable oil sources. Several types of the vegetable oils (e.g., olive, canola, safflower, sunflower, etc.) can used as sources of fatty acids to synthesize the quaternary ammonium compound. Branched chain actives (e.g., made from isostearic acid) are also effective.

Such structures include the well-known dialkyldimethylammonium salts (e.g., ditallowdimethylammonium chloride, ditallowdimethylammonium methyl sulfate, di(hydrogenated tallow)dimethyl ammonium chloride, etc.) and trialkylmethylammonium salts (e.g., tritallowmethylammonium chloride, tritallowmethylammonium methyl sulfate, tri (hydrogenated tallow)methyl ammonium chloride, etc.), in which $R_1$ are methyl groups, $R_2$ are tallow groups of varying levels of saturation, and $X^-$ is chloride or methyl sulfate.

As discussed in Swem, Ed. in Bailey's Industrial Oil and Fat Products, Third Edition, John Wiley and Sons (New York 1964), tallow is a naturally occurring material having a variable composition. Table 6.13 in the above-identified reference edited by Swem indicates that typically 78% or more of the fatty acids of tallow contain 16 or 18 carbon atoms. Typically, half of the fatty acids present in tallow are unsaturated, primarily in the form of oleic acid. Synthetic as well as natural "tallows" fall within the scope of the present invention. It is also known that depending upon the product characteristic requirements, the saturation level of the ditallow can be tailored from non hydrogenated (soft) to touch (partially hydrogenated) or completely hydrogenated (hard). All of above-described saturation levels of are expressly meant to be included within the scope of the present invention.

Mono-, di-, or triester variations of these quaternary ammonium compounds have the formula:

$$(R_1)_{4-m}—N^+—[(CH_2)_n—Y—R_3]_m X^-$$

where Y is —O—(O)C—, or —C(O)—O—, or —NH—C(O)—, or —C(O)—NH—; m is 1 to 3; n is 0 to 4; each $R_1$ is a $C_1$-$C_6$ alkyl group, hydroxyalkyl group, hydrocarbyl or substituted hydrocarbyl group, alkoxylated group, benzyl group, or mixtures thereof; each $R_3$ is a $C_{13}$-$C_{21}$ alkyl group, hydroxyalkyl group, hydrocarbyl or substituted hydrocarbyl group, alkoxylated group, benzyl group, or mixtures thereof; and $X^-$ is any softener-compatible anion. Preferably, Y=—O—(O)C—, or —C(O)—O—; m=2; and n=2. Each $R_1$ substituent is preferably a $C_1$-$C_3$, alkyl group, with methyl being most preferred. Preferably, each $R_3$ is $C_{13}$-$C_{17}$ alkyl and/or alkenyl, more preferably $R_3$ is straight chain $C_{15}$-$C_{17}$ alkyl and/or alkenyl, $C_{15}$-$C_{17}$ alkyl, most preferably each $R_3$ is straight-chain $C_{17}$ alkyl. Optionally, the $R_3$ substituent can be derived from vegetable oil sources. Several types of the vegetable oils (e.g., olive, canola, safflower, sunflower, etc.) can used as sources of fatty acids to synthesize the quaternary ammonium compound. Preferably, olive oils, canola oils, high oleic safflower, and/or high erucic rapeseed oils are used to synthesize the quaternary ammonium compound.

As mentioned above, $X^-$ can be any softener-compatible anion. For example, acetate, chloride, bromide, methylsulfate, formate, sulfate, nitrate and the like can be used in the present invention. Preferably $X^-$ is chloride or methyl sulfate.

Specific examples of ester-functional quaternary ammonium compounds having the structures named above and suitable for use in the present invention include the well-known dimethyl sulfate quaternized ester-alkyl ammonium salts having either methyl or ethylhydroxy groups occupying the remainder of the positions on the ammonical nitrogen not substituted with the ester-alkyl functionality. The most applicable of these is the diester ditallow methyl ethylhydroxy ammonium methyl sulfate. Practical production of this molecule will invariably yield a certain fraction of a monoester-monotallow methyl di(ethylhydroxy) ammonium methyl sulfate and a certain fraction of triester tritallow methyl ammonium methyl sulfate, as well as a certain fraction of monoester, diester, and triester tertiary amines not methylated by the dimethyl sulfate during quaternization. A suitable product of this type has been obtained from Stepan Company as "Agent 2450-15". Another common example to which the present invention is applicable is the well known diester ditallow dimethyl ammonium methyl sulfate, which analogously will be accompanied by a certain monoester-monotallow dimethyl ethylhydroxy ammonium methyl sulfate and the tertiary amine analogs of these two molecules not being methylated by the dimethyl sulfate.

Similar quaternary compounds methylated by means of methyl chloride are also common and included within the scope of the above invention.

As mentioned above, typically, half of the fatty acids present in tallow are unsaturated, primarily in the form of oleic acid. Synthetic as well as natural "tallows" fall within the scope of the present invention. It is also known that depending upon the product characteristic requirements, the degree of saturation for such tallows can be tailored from non hydrogenated (soft), to partially hydrogenated (touch), or completely hydrogenated (hard). All of above-described saturation levels of are expressly meant to be included within the scope of the present invention.

It will be understood that substituents $R_1$, $R_2$ and $R_3$ may optionally be substituted with various groups such as alkoxyl, hydroxyl, or can be branched. As mentioned above, preferably each $R_1$ is methyl or hydroxyethyl. Preferably, each $R_2$ is $C_{12}$-$C_{18}$ alkyl and/or alkenyl, most preferably each $R_2$ is straight-chain $C_{16}$-$C_{18}$ alkyl and/or alkenyl, most preferably each $R_2$ is straight-chain $C_{18}$ alkyl or alkenyl. Preferably $R_3$ is $C_{13}$-$C_{17}$ alkyl and/or alkenyl, most preferably $R_3$ is straight chain $C_{15}$-$C_{17}$ alkyl and/or alkenyl. Preferably, $X^-$ is chloride or methyl sulfate. Furthermore the ester-functional quaternary ammonium compounds can optionally contain up to about 10% of the mono(long chain alkyl) derivatives, e.g.:

$$(R_1)_2—N^+—((CH_2)_2OH)\ ((CH_2)_2OC(O)R_3)\ X^-$$

as minor ingredients. These minor ingredients can act as emulsifiers and are useful in the present invention.

Depending on the softening active ingredient chosen, the desired application level and other factors as may require a particular level of softening active ingredient in the composition, the level of softening active ingredient may vary between about 10% of the composition and about 60% of the composition. Preferably, the softening active ingredient comprises between about 25% and about 50% of the composition. Most preferably, the softening active ingredient comprises between about 30% and about 45% of the composition.

Electrolyte

An electrolyte may optionally be added to the oil-in-water emulsion composition of the present invention. An electrolyte is believed to shield the electrical charge around bilayers and vesicles, reducing interactions, and lowering resistance to movement resulting in a reduction in viscosity of the system. An electrolyte meeting the general criteria described above for materials suitable for use in the vehicle of the present invention and which is effective in reducing the viscosity of a dispersion of a softening active ingredient in water is suitable for use in the vehicle of the present invention. In particular, any of the known water-soluble electrolytes meeting the above criteria may be included in the vehicle of the softening composition of the present invention. When present, the electrolyte can be used in amounts up to about 15% by weight of the softening composition, but preferably no more than about 10% by weight of the softening composition. Preferably, the level of electrolyte is between about 0.1% and about 10% by weight of the softening composition based on the anhydrous weight of the electrolyte. Still more preferably, the electrolyte is used at a level of between about 0.3% and about 1.0% by weight of the softening composition. The minimum amount of the electrolyte will be that amount sufficient to provide the desired viscosity. Suitable electrolytes include the halide, nitrate, nitrite, and sulfate salts of alkali or alkaline earth metals, as well as the corresponding ammonium salts. Other useful electrolytes include the alkali and alkaline earth salts of simple organic acids such as sodium formate and sodium acetate, as well as the corresponding ammonium salts. Preferred inorganic electrolytes include the chloride salts of sodium, calcium, and magnesium. Calcium chloride is a particularly preferred inorganic electrolyte for the softening composition of the present invention. A particularly preferred organic acid salt-based electrolyte is sodium formate.

Optional Components of the Softening Composition Plasticizer

The formation of the oil-in-water emulsion may be more effectively accomplished with the addition of an optional appropriate plasticizer to the oil phase of the emulsion. The term "plasticizer" as used herein refers to an ingredient capable of reducing the melting point and viscosity at a given temperature of a quaternary ammonium ingredient. The plasticizer, if used, can be added during the quaternizing step in the manufacture of the quaternary ammonium ingredient or it can be added subsequent to the quaternization but prior to the application as a softening active ingredient. The plasticizer is characterized by being substantially inert during the chemical synthesis which acts as a viscosity reducer to aid in the synthesis. Preferred plasticizers are non-volatile polyhydroxy compounds. Preferred polyhydroxy compounds include glycerol and polyethylene glycols having a molecular weight of from about 200 to about 2000, with polyethylene glycol having a molecular weight of from about 200 to about 600 being particularly preferred. When such plasticizers are added during manufacture of the quatemary ammonium ingredient, they comprise between about 2% and about 75% percent of the product. Particularly preferred mixtures comprise between about 5% and about 50% plasticizer, and more preferably comprise between about 10% and 25%.

Bilayer Disrupter

A bilayer disrupter may also be added to the oil-in-water emulsions of the present invention. Bilayer disrupters useful in the compositions of the present invention are preferably surface active materials. Such materials comprise both hydrophobic and hydrophilic moieties. A preferred hydrophilic moiety is a polyalkoxylated group, preferably a polyethoxylated group. Such preferred bilayer disrupters when used are used at a level of between about 1% and about 20% of the level of the softening active ingredient. Preferably, the bilayer disrupter is present at a level of between about 2% and about 15% of the level of the softening active ingredient, and more preferably at a level of between about 3% and about 10%.

Particularly preferred bilayer disrupters are nonionic surfactants derived from saturated and/or unsaturated primary and/or secondary, amine, amide, amine-oxide fatty alcohol, fatty acid, alkyl phenol, and/or alkyl aryl carboxylic acid compounds, each preferably having from about 6 to about 22, more preferably from about 8 to about 18, carbon atoms in a hydrophobic chain, more preferably an alkyl or alkylene chain, wherein at least one active hydrogen of said compounds is ethoxylated with $\leqq 50$, preferably $\leqq 30$, more preferably from about 3 to about 15, and even more preferably from about 5 to about 12, ethylene oxide moieties to provide an HLB (Hydrophile-Lipophile Balance) of from about 6 to about 20, preferably from about 8 to about 18, and more preferably from about 10 to about 15. A more complete description of suitable bilayer disrupters for use in compositions containing quaternary softening active is found in U.S. patent application Ser. No. 09/413,578 (Published as WO 00/22231).

Minor Components

The vehicle can also comprise minor ingredients as may be known to the art, examples include: mineral acids or buffer systems for pH adjustment (may be required to maintain hydrolytic stability for certain softening active ingredients) and antifoam ingredients (e. g., a silicone emulsion as is available from Dow Corning, Corp. of Midland, Mich. as Dow Corning 2310) as a processing aid to reduce foaming when the softening composition of the present invention is applied to a web of tissue.

It may also be desirable to provide means to control the activity of undesirable microorganisms in the softening composition of the present invention. It is known that organisms, such as bacteria, molds, yeasts, and the like, can cause degradation of the composition on storage. Undesirable organisms can also potentially transfer to users of tissue paper products that are softened with a composition according to the present invention that is contaminated by such organisms. These undesirable organisms can be controlled by adding an effective amount of a biocidal material to the softening composition. Proxel GXL, as is available from Avecia, Inc. of Wilmington, Del., has been found to be an effective biocide in the composition of the present invention when used at a level of about 0.1%. Alternatively, the pH of the composition can be made more acid to create a more hostile environment for undesirable microorganisms. Means such as those described above can be used to adjust the pH to be in a range of between about 2.5 to 4.0, preferably between about 2.5 and 3.5, more preferably between about 2.5 and about 3.0 so as to create such a hostile environment.

Stabilizers may also be used to improve the uniformity and shelf life of the dispersion. For example, an ethoxylated polyester, HOE S 4060, available from Clariant Corporation of Charlotte, N.C. may be included for this purpose.

Vehicle

As used herein a "vehicle" is used to dilute the active ingredients of the compositions described herein forming the emulsions of the present invention. A vehicle may dissolve such components (true solution or micellar solution) or such components may be dispersed throughout the vehicle (dispersion or emulsion). The vehicle of a suspension or emulsion is typically the continuous phase thereof. That is, other components of the dispersion or emulsion are dispersed on a molecular level or as discrete particles throughout the vehicle.

For purposes of the present invention, one purpose that the vehicle serves is to dilute the concentration of softening active ingredients so that such ingredients may be efficiently and economically applied to a tissue web. For example, as is discussed below, one way of applying such active ingredients is to spray them onto a roll which then transfers the active ingredients to a moving web of tissue. Typically, only very low levels (e. g. on the order of 2% by weight of the associated tissue) of softening active ingredients are required to effectively improve the tactile sense of softness of a tissue. This means very accurate metering and spraying systems would be required to distribute a "pure" softening active ingredient across the full width of a commercial-scale tissue web.

Preferred applications of the present invention occur when there is an enhanced need to minimize the amount of the aqueous phase vehicle in the oil-in-water emulsion. Preferably, the continuous aqueous phase of the emulsions comprise less than about 45%, more preferably less than about 35%, and most preferably less than about 25% by weight of the emulsion composition.

Another purpose of the vehicle is to deliver the active softening composition in a form in which it is less prone to be mobile with regard to the tissue structure. Specifically, it is desired to apply the composition of the present invention so that the active ingredient of the composition resides primarily on the surface of the absorbent tissue web with minimal absorption into the interior of the web. While not wishing to be bound by theory, the Applicants believe that the interaction of the softening composition with preferred vehicles creates a suspended particle which binds more quickly and permanently than if the active ingredient were to be applied without the vehicle. For example, it is believed that suspensions of quaternary softeners in water assume a liquid crystalline form which can be substantively deposited onto the surface of the fibers of the surface of the tissue paper web. Quaternary softeners applied without the aid of the vehicle, e. g. applied in molten form by contrast tend to wick into the internal of the tissue web.

While softening ingredients can be dissolved in a vehicle forming a solution therein, materials that are useful as solvents for suitable softening active ingredients are not commercially desirable for safety and environmental reasons. Therefore, to be suitable for use in the vehicle for purposes of the present invention, a material should be compatible with the softening active ingredients described herein and with the tissue substrate on which the softening compositions of the present invention will be deposited. Further a suitable material should not contain any ingredients that create safety issues (either in the tissue manufacturing process or to users of tissue products using the softening compositions described herein) and not create an unacceptable risk to the environment. Suitable materials for the vehicle of the present invention include hydroxyl functional liquids most preferably water.

High Molecular Weight Polymers

High molecular weight polymers which are substantially compatible with the vehicle can also be useful in order to achieve the desired rheology characteristics for the oil-in-water emulsions herein. As used herein, the term "substantially compatible" means that the high molecular weight polymer appears to dissolve in the vehicle as the continuous aqueous phase of the emulsion is being prepared (i.e., the continuous phase appears transparent or translucent to the naked eye).

Such polymers also should not destabilize the oil-in-water emulsion due to their presence. For example, a suitable high molecular weight polymer would not have a sufficiently large number of anionic substituents so as to cause flocculation of the emulsion. It may be necessary to adjust certain properties of the composition in order to insure stability. For example insure that an anionic has a sufficiently low level of anionic character (e.g. via pH adjustment of a presolution of the polymer so as to approach the isoelectric point) so as not to cause flocculation.

Without being bound by theory, it is believed that polymers suitable for use herein preferably self-interact within the vehicle at the molecular level and with droplets of the softening active ingredient (e.g. via entanglement, surface absorption, and ionic attraction) in order to increase the extensibility of the softening composition to with a resulting reduction in spray fracture.

The polymers useful herein are preferably high molecular weight, substantially linear chain molecules. The high molecular weight of the polymer enables it to enhance the extensibility of the softening composition such that the composition is suitable for extensional processes in a spray apparatus. In one embodiment, the high molecular weight polymer preferably has a substantially linear chain structure, though a linear chain having short ($C_1$-$C_3$) branches or a branched chain having one to three long branches are also suitable for use herein.

In order to effectively interact with other high molecular weight polymer molecules and with the softening active ingredient particles, the high molecular weight polymer suitable for use herein should have a weight-average molecular weight of at least 500,000. Typically the weight average molecular weight of the polymer ranges from about 500,000 to about 25,000,000, more typically from about 1,000,000 to about 22,000,000, even more typically from about 2,000,000 to about 20,000,000, and most typically from about 5,000,000 to about 15,000,000. The high molecular weight polymers are preferred in some embodiments of the invention due to the ability to simultaneously interact with several particles of softening active ingredient, thereby increasing extensional viscosity and reducing spray fracture.

Nonlimiting examples of suitable high molecular weight polymers include polyacrylamide and certain derivatives acrylic polymers and copolymers as may be compatible with the softening composition of the present invention; vinyl polymers including polyvinyl alcohol; polyvinylacetate; polyvinylpyrrolidone; polyethylene vinyl acetate; polyethyleneimine; and the like; polyalkylene oxides such as polyethylene oxide; polypropylene oxide; polyethylene/propylene oxide; and mixtures thereof. Copolymers made from mixtures of monomers selected from any of the aforementioned polymers are also suitable herein. Other exemplary high molecular weight polymers include water soluble polysaccharides such as alginates, carrageenans, pectin and derivatives, chitin and derivatives, and the like; gums such as guar gum, xanthum gum, agar, gum arabic, karaya gum, tragacanth gum, locust bean gum, and like gums; water soluble derivatives of cellulose, such as alkylcellulose, hydroxyalkylcellulose, carboxyalkylcellulose, and the like; and mixtures thereof.

Some polymers (e.g., polyacrylic acid, polymethacrylic acid) are generally not available in the high molecular weight range (i.e., 500,000 or higher). A small amount of crosslinking agents may be added to create branched polymers of suitably high molecular weight useful herein.

The high molecular weight polymer, when used in a spraying process, is added to the composition of the present invention in an amount effective to visibly reduce spray fracture and the resulting aerosolization during the spraying process such that substantially all of the softening composition is deposited onto the tissue web. These polymers, when used, are typically present in the range from about 0.0005% to about 0.5 wt %, preferably from about 0.0005% to about 0.1 wt %, more preferrably from about 0.001 to about 0.05 wt %, and most preferred from about 0.0025 wt % to about 0.01 wt % of the composition. A particularly preferred range is between about 0.005 wt % and about 0.01 wt %. It is surprising to find that at these very low concentrations these polymers can significantly improve the air pressure operating window in a spray apparatus.

Preferred polymers will contain functional groups with a tendency to ionize in water dispersion. These functional groups may be contained within the polymer backbone or as pendant groups. Since the preferred dispersions targeted for polymer modification are cationic, the preferred polymers have cationic character.

Cationic polymers generally originate from copolymerization of one or more ethylenically uinsaturated monomers, generally acrylic monomers, that consist of or include cationic monomer. Suitable cationic monomers are dialkyl amino alkyl (meth) acrylates or—(meth) acrylamides, either as acid salts or quaternary ammonium salts. Suitable alkyl groups include dialkylaminoethyl (meth) acrylates, dialkylaminoethyl (meth) acrylamides and dialkyl aminomethyl (meth) acrylamides and dialkylamino-1,3-propyl (meth) acrylamides. These cationic monomers are preferably acrylamide. Other suitable polymers are polyethyleimines, polyamdie epichlorohydrin polymers, and homopolymers or coolymers, generally with acrylamide, of monomers such as diallyl dimethyl ammonium chloride.

Substituent or pendant groups deliver a charge density of at least about 0.2, more preferably more than 1.5, and most preferably more than about 2.5 meq/g.

The preferred method of delivering these low levels of high molecular weight polymers to the composition is via a water-in-oil emulsion. The water-in-oil emulsion for the delivery of the polymers comprises approximately 20-50% of active polymer contained in 40-60% water droplets as the dispersed phase. The 20-40% balance of the emulsion is in the continuous phase in the form of an organic solvent. Typically, this organic solvent is a petroleum distillate, such as kerosene, which consists mainly of saturated hydrocarbons with chain length of 10. The polymer in the emulsion exists within the minute drops of water suspended in the organic continuous fluid. The emulsion polymer has an opaque, milky appreance. The polymer in an emulsion product exists in its fully hydrated conformation, however it is contained in the emulsion within the small suspended aqueous droplets. The rheological properties of the emulsion are predominantly determined by the organic solvent with a minimal impact by the existence of the polymer. However, with dilution, into the bulk fluid, the emulsion is inverted from the water-in-oil form into an oil-in-water emulsion, thereby releasing the water/polymer mixture into the aqueous vehicle. Upon release into the aqueous vehicle, the contained polymer chains extend throughout the softening composition, causing an increase in shear viscosity and a particular increase in extension viscosity as evidence by the stringiness of the treated fluid.

Forming the Oil-in-Water Emulsion Composition

As noted above, the preferred embodiment of the oil-in-water emulsions of the present invention are softening compositions having a softening active ingredient emulsified in a vehicle. As noted above, the preferred primary component of the vehicle is water. Depending on the softening active ingredient chosen, the desired application level and other factors as may require a particular level of softening active ingredient in the composition, the level of softening active ingredient may vary between about 10% of the composition and about 60% of the composition in the vehicle chosen. The composition also comprises a high molecular weight polymer added as an water-in-oil emulsion.

Optionally, nonionic surfactant, or plasticizer may be added at desired levels. In addition, the composition may optionally comprise minor ingredients to adjust pH, to control foam, or to aid in stability of the dispersion.

Tissue Paper

The present invention is preferably applicable to tissue paper in general, including but not limited to: conventionally felt-pressed tissue paper; pattern densified tissue paper; and high-bulk, uncompacted tissue paper. The tissue paper may be of a homogenous or multilayered construction; and tissue paper products made therefrom may be of a single-ply or multi-ply construction. The tissue paper preferably has a basis weight of between about 10 g/m$^2$ and about 80 g/m$^2$, and density of about 0.60 g/cc or less. Preferably, the basis weight will be below about 35 g/m$^2$ or less; and the density will be about 0.30 g/cc or less. Most preferably, the density will be between about 0.04 g/cc and about 0.20 g/cc.

Conventionally pressed tissue paper and methods for making such paper are known in the art. See commonly assigned U.S. patent application Ser. No. 09/997,950 filed Nov. 30, 2001. Preferred processes for making pattern densified tissue webs are disclosed in U.S. Pat. No. 3,301,746, issued to Sanford and Sisson on Jan. 31, 1967, U.S. Pat. No. 3,974,025, issued to Ayers on Aug. 10, 1976, U.S. Pat. No. 4,191,609, issued to on Mar. 4, 1980, and U.S. Pat. No. 4,637,859, issued to on Jan. 20, 1987; U.S. Pat. No. 3,301,746, issued to Sanford and Sisson on Jan. 31, 1967, U.S. Pat. No. 3,821,068, issued to Salvucci, Jr. et al. on May 21, 1974, U.S. Pat. No. 3,974,025, issued to Ayers on Aug. 10, 1976, U.S. Pat. No. 3,573,164, issued to Friedberg, et al. on Mar. 30, 1971, U.S. Pat. No. 3,473,576, issued to Amneus on Oct. 21, 1969, U.S. Pat. No. 4,239,065, issued to Trokhan on Dec. 16, 1980, and U.S. Pat. No. 4,528,239, issued to Trokhan on Jul. 9, 1985,.

Uncompacted, non pattern-densified tissue paper structures are also contemplated within the scope of the present invention and are described in U.S. Pat. No. 3,812,000 issued to Joseph L. Salvucci, Jr. and Peter N. Yiannos on May 21, 1974, and U.S. Pat. No. 4,208,459, issued to Henry E. Becker, Albert L. McConnell, and Richard Schutte on Jun. 17, 1980.

The softening composition of the present invention can also be applied to uncreped tissue paper. Uncreped tissue paper, a term as used herein, refers to tissue paper which does not employ a Yankee dryer, i.e. is non-compressively dried, most preferably by through air drying. Resultant through air dried webs are pattern densified such that zones of relatively high density are dispersed within a high bulk field, including pattern densified tissue wherein zones of relatively high density are continuous and the high bulk field is discrete. The techniques to produce uncreped tissue in this manner are taught in the prior art. For example, Wendt, et. al. in European Patent Application 0 677 612A2, published Oct. 18, 1995; Hyland, et. al. in European Patent Application 0 617 164 A1, published Sep. 28, 1994; and Farrington, et. al. in U.S. Pat. No. 5,656,132 published Aug. 12, 1997.

The papermaking fibers utilized for the present invention will normally include fibers derived from wood pulp. Other cellulosic fibrous pulp fibers, such as cotton linters, bagasse, etc., can be utilized and are intended to be within the scope of this invention. Synthetic fibers, such as rayon, polyethylene and polypropylene fibers, may also be utilized in combination with natural cellulosic fibers. One exemplary polyethylene fiber which may be utilized is Pulpex®, available from Hercules, Inc. (Wilmington, Del.).

Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, are preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. Also applicable to the present invention are fibers derived from recycled paper, which may contain any or all of the above categories as well as other non-fibrous materials such as fillers and adhesives used to facilitate the original papermaking.

Other materials can be added to the aqueous papermaking furnish or the embryonic web to impart other desirable characteristics to the product or improve the papermaking process so long as they are compatible with the chemistry of the softening composition and do not significantly and adversely affect the softness or strength character of the present invention. The following materials are expressly included, but their inclusion is not offered to be all-inclusive. Other materials can be included as well so long as they do not interfere or counteract the advantages of the present invention.

It is common to add a cationic charge biasing species to the papermaking process to control the zeta potential of the aqueous papermaking furnish as it is delivered to the papermaking process. An exemplary material is Cypro 514®, a product of Cytec, Inc. of Stamford, Conn. The use of such materials is expressly allowed within the practice of the present invention.

The use of high surface area, high anionic charge microparticles for the purposes of improving formation, drainage, strength, and retention is taught in the art. See, for example, U.S. Pat. No. 5,221,435, issued to Smith on Jun. 22, 1993.

If permanent wet strength is desired, cationic wet strength resins can be added to the papermaking furnish or to the embryonic web. Suitable types of such resins are described in U.S. Pat. No. 3,700,623, issued on Oct. 24, 1972, and U.S. Pat. No. 3,772,076, issued on Nov. 13, 1973, both to Keim.

If fugitive wet strength is desired, the binder materials can be chosen from the group consisting of dialdehyde starch or other resins with aldehyde functionality such as Co-Bond 1000® offered by National Starch and Chemical Company of Scarborough, Me.; Parez 750® offered by Cytec of Stamford, Conn.; and the resin described in U.S. Pat. No. 4,981,557, issued on Jan. 1, 1991, to Bjorkquist, and other such resins having the decay properties described above as may be known to the art.

If enhanced absorbency is needed, surfactants may be used to treat the tissue paper webs of the present invention. The level of surfactant, if used, is preferably from about 0.01% to about 2.0% by weight, based on the dry fiber weight of the tissue web. The surfactants preferably have alkyl chains with eight or more carbon atoms. Exemplary anionic surfactants include linear alkyl sulfonates and alkylbenzene sulfonates. Exemplary nonionic surfactants include alkylglycosides including alkylglycoside esters such as Crodesta SL-40® which is available from Croda, Inc. (New York, N.Y.); alkylglycoside ethers as described in U.S. Pat. No. 4,011,389, issued to Langdon, et al. on Mar. 8, 1977; and alkylpolyethoxylated esters such as Pegosperse 200 ML available from Glyco Chemicals, Inc. (Greenwich, Conn.) and IGEPAL RC-520® available from Rhone Poulenc Corporation (Cranbury, N.J.). Alternatively, cationic softener active ingredients with a high degree of unsaturated (mono and/or poly) and/or branched chain alkyl groups can greatly enhance absorbency.

While the preferred embodiment of the present invention discloses a certain softening agent composition deposited on the tissue web surface, the invention also expressly includes variations in which the chemical softening agents are added as a part of the papermaking process. For example, chemical softening agents may be included by wet end addition. In addition, other chemical softening agents, in a form not within the scope of the present invention may be used. Preferred chemical softening agents comprise quaternary ammonium compounds including, but not limited to, the well-known dialkyldimethylammonium salts (e.g., ditallowdimethylammonium chloride, ditallowdimethylammonium methyl sulfate, di(hydrogenated tallow)dimethyl ammonium chloride, etc.). Another class of papermaking-added chemical softening agents comprise the well-known organo-reactive polydimethyl siloxane ingredients, including the most preferred amino functional polydimethyl siloxane.

Filler materials may also be incorporated into the tissue papers of the present invention. U.S. Pat. No. 5,611,890, issued to Vinson et al. on Mar. 18, 1997, and, incorporated herein by reference discloses filled tissue paper products that are acceptable as substrates for the present invention.

The above listings of optional chemical additives is intended to be merely exemplary in nature, and are not meant to limit the scope of the invention.

Spray Application Method

The preferred paper softening oil-in-water emulsion may be applied to the tissue paper at levels preferably between about 0.1% and about 10% based on the total weight of the softening composition compared to the total weight of the resulting tissue paper. The resulting tissue paper preferably has a basis weight of from about 10 to about 80 g/m$^2$ and a fiber density of less than about 0.6 g/cc. The levels of softener additives used to soften the tissue paper are low enough that the tissue paper retains high wettability.

In an especially preferred embodiment, the composition of the present invention is applied to an overdried tissue web shortly after it is separated from a drying means and before it is wound onto a parent roll. Alternatively, the composition of the present invention may be applied to a semi-dry tissue web, for example while the web is on the Fourdrinier cloth, on a drying felt or fabric, or while the web is in contact with the Yankee dryer or other alternative drying means. Finally, the composition can also be applied to a dry tissue web in moisture equilibrium with its environment as the web is unwound from a parent roll as for example during an off-line converting operation.

In one preferred embodiment, the softening composition of the current invention may be applied after the tissue web has been dried and creped, and, more preferably, while the web is still at an elevated temperature. Preferably, the softening composition is applied to the dried and creped tissue web before the web is wound onto the parent roll. Thus, in a preferred embodiment of the present invention the softening composition is applied to a hot, overdried tissue web after the web has been creped and after the web has passed through the calender rolls which control the caliper.

The softening composition described above is preferably applied to the web in a macroscopically uniform fashion so that substantially the entire sheet benefits from the effect of the softening composition. Following application to the hot web, at least a portion of the volatile components of the vehicle preferably evaporates leaving preferably a thin film containing any remaining unevaporated portion of the volatile components of the vehicle, the softening active ingredient, and other nonvolatile components of the softening composition. By "thin film" is meant any thin coating, haze or mist on the web. This thin film can be microscopically continuous or be comprised of discrete elements. If the thin film is comprised of discrete elements, the elements can be of uniform size or varying in size; further they may be arranged in a regular pattern or in an irregular pattern, but macroscopically the thin film is uniform. Preferably the thin film is composed of discrete elements.

The softening composition can be added to either side of the tissue web singularly, or to both sides.

A preferred method of macroscopically uniformly applying the softening composition to the web is spraying. Spraying has been found to be economical, and can be accurately controlled with respect to quantity and distribution of the softening composition, so it is more preferred. The dispersed softening composition is applied onto the dried, creped tissue web after the Yankee dryer and before the parent roll. A particularly convenient means of accomplishing this application is to apply the softening composition to the web after the calender rolls and before the parent roll. A particularly preferred application position is between the calender rolls and any spreading roll that may be positioned between the calender rolls and the parent roll. Such position is particularly preferred because the web is controlled by rolls at each end of the span where the composition is applied and there is still some web path length before the web is wound onto the parent roll for volatilization of the vehicle.

FIG. 1 illustrates a preferred method of applying the softening composition to the tissue web. Referring to FIG. 1, a wet tissue web 1 is on carrier fabric 14 past turning roll 2 and transferred to Yankee dryer 5 by the action of pressure roll 3 while carrier fabric 14 travels past turning roll 16. The web is adhesively secured to the cylindrical surface of Yankee dryer 5 by adhesive applied by spray applicator 4. Drying is completed by steam-heated Yankee dryer 5 and by hot air which is heated and circulated through drying hood 6 by means not shown. The web is then dry creped from the Yankee dryer 5 by doctor blade 7, after which it is designated creped paper sheet 15. Paper sheet 15 then passes through calender rolls 10 and 11. The softening composition is then applied to sheet 15 by spray applicator 8 in the span between calender rolls 10, 11 and spreading roll 9. The treated sheet 15 then travels over a circumferential portion of reel 12 and is wound onto parent roll 13 after a portion of the vehicle has evaporated as the web passes through the span between spreading roll 9 and reel 12.

Suitably, the softening composition is disposed at a level of between about 0.1% and about 8% of the weight of the paper sheet 15, preferably between about 0.1% and about 5%, more preferably between about 0.1% and about 3%.

While not wishing to be bound by theory or to otherwise limit the present invention, the following description of typical process conditions encountered during the papermaking operation and their impact on the process described in this invention is provided. The Yankee dryer raises the temperature of the tissue sheet and removes the moisture. The steam pressure in the Yankee is on the order of 110 PSI (750 kPa). This pressure is sufficient to increase the temperature of the cylinder to about 170° C. The temperature of the paper on the cylinder is raised as the water in the sheet is removed. The temperature of the sheet as it leaves the doctor blade can be in excess of 120° C. The sheet travels through space to the calender and the reel and loses some of this heat. The temperature of the paper wound in the reel is measured to be on the order of 60° C. Eventually the sheet of paper cools to room temperature. This can take anywhere from hours to days depending on the size of the paper roll. As the paper cools it also absorbs moisture from the atmosphere.

Since the softening composition of the present invention is applied to the paper while it is overdried, the water added to the paper with the softening composition by this method (i.e. residual water that does not evaporate in the span between spreading roll 9 and reel 12) is not sufficient to cause the paper to lose a significant amount of its strength and thickness. Thus, no further drying is required.

Test Method

Ultracentrifugation Measurement

To test a composition for percent aqueous continuous phase, ultracentrifugation with a Beckman L8-80 model can be used. Load approximately 12 grams of the composition into a Beckman # 331374 centifuge tube. The exact weight is not critical; however an even number of tubes, i.e. two, four, or six, must be loaded into the centrifuge, and the combined weight of the composition and tube in each case must be equalized within 0.05 g to insure instrument balance and performance.

Centrifuge according to the instrument instructions for a period of 16 hours at a temperature of 25 degrees C. Upon completion of the centrifugation, remove the centrifuge tubes, taking care to keep the tubes vertical, maintaining the separation between the continuous and dispersed phases for measurements.

Measure the length of the continuous (liquid) phase and the total length of the continuous and dispersed phases and calculate the percent aqueous continuous phase (% ACP) according to the formula:

$$\%\ ACP=(144.2\times(h-L)\times 100)/((144.2\times h)+660),$$

wherein

"L" is the length of the liquid (continuous) phase minus the curvature of the tube.

"H" is the length of the liquid and solid (dispersed) phases minus the curvature of the tube.

"660" is the volume of the liquid phase in the curvature of the tube.

"144.2" is used to convert phase length measurements (mm) into volume (by $\pi r^2$).

The phase length measurements should be made with electronic digital calipers (Sears catalog #9-40160 or equivalent).

EXAMPLE

Example 1

An example dispersion according to the present invention is prepared as follows. The materials comprising this composition is more specifically defined in Table 1 which follows this description. Amounts used in each step are sufficient to result in the finished composition detailed in that table. The appropriate quantity of water is heated (extra water may be added to compensate for evaporation loss) to about 200° F. (93° C.). Sulfuric acid (38% solution) and antifoam ingredient and nonionic surfactant is added to the water while maintaining temperature. Concurrently, the blend of softening active ingredient and plasticizer is melted by heating it to a temperature of about 190° F. (88° C.). The melted mixture of softening active ingredient and plasticizer is then slowly added to the heated acidic aqueous phase with mixing to evenly distribute the disperse phase throughout the vehicle.

Once the softening active ingredient is thoroughly dispersed and the dispersion temperature is 160-170° F. (71-77° C.), part of the sodium formate is added (as a 5% solution) intermittently with mixing to provide an initial viscosity reduction. The stabilizer is then slowly added to the mixture with continued agitation. After the dispersion cools to 120-140° F. (49-60° C.), the sodium formate (as a 25% solution) is then added for further viscosity reduction. Lastly, the extension aid polymer is added with continued mixing. The dispersion is allowed to stand for at least about 2 hours for the polymer to complete relaxation before any measurements or use of the dispersion is attempted. For purposes of determining active ingredients, quat active is equal to cationic active.

TABLE 1

| Component | Concentration |
|---|---|
| Continuous Phase | |
| Water | QS to 100% |
| Electrolyte[1] | 2.51% |
| Antifoam[2] | 0.23% |
| Bilayer Disrupter[3] | 0.6% |
| Sulfuric Acid[4] | 0.77% |
| Plasticizer[5] | 17.4% |
| Stabilizer[6] | 1.5% |
| Extension Aid Polymer Emulsion[7] | 0.02% |
| Disperse Phase | |
| Softening Active Ingredient[5] | 45% |

[1]0.55% from 5% aqueous sodium formate solution, 1.0% from 25% aqueous sodium formate solution.
[2]Silicone Emulsion (10% active)-Dow Corning 2310 ®, marketed by Dow Corning Corp., Midland, MI
[3]Suitable nonionic surfactants are available from Shell Chemical of Houston, TX under the trade name NEODOL 91-8.
[4]Available as a 38% solution from J. T. Baker Chemical Company of Phillipsburg, NJ (The acid % in the tables reflects as is at 38%)
[5]Plasticizer, softening active ingredient and inert ingredients obtained pre-blended from Goldschmidt Chemical Corporation of Dublin, OH as DXP 5558-66 and comprises about 25% polyethylene glycol 400.
[6]Stabilizer is Texcare 4060, from Clariant Corp., Charlotte, NC
[7]Polymer Emulsion is Ciba Specialty Chemicals' of Basel Switzerland, E-20 cationic polymer emusion (40% actives)

1. 0.55% from 5% aqueous sodium formate solution, 1.0% from 25% aqueous sodium formate solution.

2. Silicone Emulsion (10% active)—Dow Corning 2310®, marketed by Dow Corning Corp., Midland, Mich.

3. Suitable nonionic surfactants are available from Shell Chemical of Houston, Tex. under the trade name NEODOL 91-8.

4. Available as a 38% solution from J. T. Baker Chemical Company of Phillipsburg, N.J. (The acid % in the tables reflects as is at 38%)

5. Plasticizer, softening active ingredient and inert ingredients obtained pre-blended from Goldschmidt Chemical Corporation of Dublin, Ohio as DXP 5558-66 and comprises about 25% polyethylene glycol 400.

6. Stabilizer is Texcare 4060, from Clariant Corp., Charlotte, N.C.

7. Polymer Emulsion is Ciba Specialty Chemicals' of Basel Switzerland, E-20 cationic polymer emusion (40% actives)

The resulting chemical softening composition is a milky, low viscosity dispersion suitable for application to cellulosic structures as described below for providing desirable tactile softness to such structures. It displays a shear-thinning non-Newtonian viscosity. The resulting chemical composition comprises less than 25% aqueous continuous phase as determined by ultracentrifugation.

What is claimed is:

1. A composition for softening an absorbent paper tissue comprising:

a) a quaternary ammonium softening active ingredient;

b) an electrolyte;

c) a vehicle in which said softening active ingredient is dispersed;

wherein the rheology of the composition is modified by the addition of a water-in-oil emulsion comprising:

i) from about 20% to about 40% by weight of the premix of a high molecular weight polymer;

ii) from about 40% to about 60% of water; and iii) from about 20% to about 40% of an organic solvent. and wherein the composition exhibits consistent spray fracture.

2. A composition for softening an absorbent paper tissue comprising:

a) from about 10% to about 60% by weight of the composition of a quatemary ammonium softening active ingredient;

b) an electrolyte;

c) from about 0.0005% to about 0.5% of a high molecular weight polymer;

d) an aqueous vehicle in which said softening active ingredient is dispersed;

wherein the rheology of the aqueous vehicle is modified by the addition of a water-in-oil emulsion comprising:

i) the high molecular weight polymer in a discontinuous aqueous phase, and ii) a continuous organic solvent phase; and wherein the composition exhibits consistent spray fracture.

3. The composition of claim 2 wherein said softening active ingredient is selected from the group consisting of quaternary compounds; mono-, di-, and tri-ester quaternary ammonium compounds, and mixtures thereof.

4. The composition of claim 3 wherein said softening active ingredient is a mono-, di-, or tri-ester quaternary ammonium compound having the formula:

$$(R_l)4\text{-}m^{-N+}\text{-}[(CH_2)_n\text{-}Y\text{-}R_3]_m X^-$$

wherein Y is —O-(O)C—, or —C(O)—O—, or —NH—C(O)-, or —C(O)—NH—; m is 1 to 3; n is 0 to 4; each $R_1$ is a $C_1$-$C_6$ alkyl or alkenyl group, hydroxyalkyl group, hydrocarbyl or substituted hydrocarbyl group, alkoxylated group, benzyl group, or mixtures thereof; each $R_3$ is a $C_{13}$-$C_{21}$ alkyl or alkenyl group, hydroxyalkyl group, hydrocarbyl or substituted hydrocarbyl group, alkoxylated group, benzyl group, or mixtures thereof; and $X^-$ is any softener-compatible anion.

5. The composition of claim 4 wherein m is 3, n is 2, $R_1$ is methyl, $R_3$ is $C_{15}$-$C_{17}$ alkyl, and Y is —O-(O)C—, or —C(O)—O—.

6. The composition of claim 1 further comprising from about 2% to about 75% by weight of a plasticizer.

7. The composition of claim 1 wherein the electrolyte comprises up to about 15% by weight of the composition.

8. The composition of claim 1 further comprising from about 1% to about 20% by weight of the composition of a bilayer disrupter.

9. The composition of claim 1 wherein the vehicle is water.

* * * * *